US006041934A

United States Patent [19]

Alexson

[11] Patent Number: 6,041,934

[45] Date of Patent: Mar. 28, 2000

[54] PORTABLE SCORING APPARATUS INCLUDING CARRYING CASE

[76] Inventor: Donna Jaquith Alexson, 38 Farley Ave., Ipswich, Mass. 01938

[21] Appl. No.: 09/277,537

[22] Filed: Mar. 26, 1999

[51] Int. Cl.[7] ..... B65D 71/00; G09F 11/08; A63F 7/22

[52] U.S. Cl. ..... 206/579; 40/489; 40/606; 116/223

[58] Field of Search ..... 206/579; 116/222, 116/223, 225, 321; 40/489, 490, 605, 606, 610; 273/408, DIG. 26

[56] References Cited

U.S. PATENT DOCUMENTS

| | | | |
|---|---|---|---|
| 619,053 | 2/1899 | Steed | 116/223 |
| 710,993 | 10/1902 | Norrington | 116/223 X |
| 2,065,624 | 12/1936 | Summers | 116/223 |
| 2,608,011 | 8/1952 | Ten Hoeve et al. | 40/606 X |
| 3,576,174 | 4/1971 | Topel | 116/222 |
| 5,054,792 | 10/1991 | Danielson | 273/408 |
| 5,615,636 | 4/1997 | Gustafson | 116/223 |
| 5,620,099 | 4/1997 | Bickett et al. | 206/579 |

*Primary Examiner*—Bryon P. Gehman
*Attorney, Agent, or Firm*—Paul J. Cook

[57] ABSTRACT

A portable scoring apparatus is provided comprising a carrying case is formed of two half sections joined together by a flexible connecting section. The half sections are capable of being pivoted with respect to each other at least about 180 degrees. The two half sections can be open during use and closed during transport. A plurality of scoring elements having numeric indicia are secured to an inside surface of one of the half sections. The scoring elements are pivotable so that they can be supported by the inside surface of the second half section. The scoring elements have the same numeric indicia on both their top surfaces and their bottom surfaces so that different venues at a sporting event can view the correct score.

8 Claims, 5 Drawing Sheets

PORTABLE SCORING APPARATUS INCLUDING CARRYING CASE

BACKGROUND OF THE INVENTION

1. Field of the Invention

This invention relates to a portable, light weight scoring apparatus useful in conjunction with a sporting event. More particularly, this invention relates to such an apparatus which can be hand carried and which includes a flexible housing that facilitates its use at a sporting event.

2. Description of Prior Art

At the present time, scoring of a sporting event is effected with a permanently positioned scoreboard or with a support such as a pole and stand or the like to support alphanumeric indicia. Such scoring systems have limited or no portability which essentially limits their use to a specific venue for sporting events.

It would be desirable to provide a scoring apparatus for sporting events which is portable, light weight and flexible to facilitate its transportation to a multiplicity of sporting venues for use in scoring a wide variety of sporting events.

SUMMARY OF THE INVENTION

The present invention provides a scoring apparatus including a carrying case formed of elements that are sufficiently flexible to permit it to be hung, fully opened on a rope support. Flexible scoring elements having one or more letters and/or numbers are secured to the interior of the carrying case such as by being sewn thereto. The scoring elements can be rotated to expose either surface of the scoring element. Since the carrying case is flexible, scoring elements can be positioned about 180 degrees from each other so that spectators positioned on opposing sides of a sporting venue can view the score on the scoring elements.

The carrying case having the scoring elements exposed can be hung from a thin support such as a rope of a net used in a sporting event, can be positioned on a flat surface or can be hung from a permanent substrate.

DESCRIPTION OF SPECIFIC EMBODIMENTS

Figure 1:
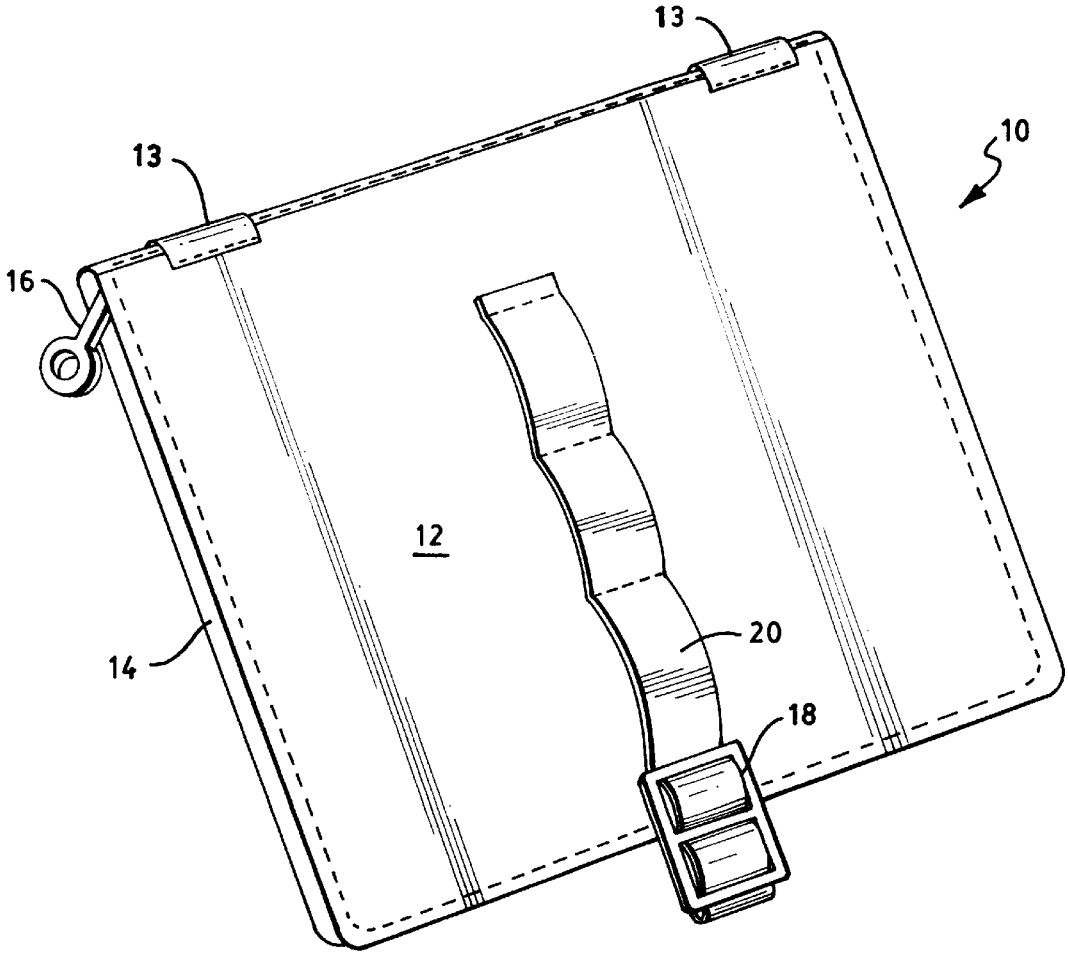
FIG. 1 is a top view of the scoring apparatus of this invention when closed.

Referring to FIG. 1, the closed carrying case 10 of this invention is shown. The carrying case 10 is formed of a flexible material such as woven cloth formed of a natural fiber such as cotton or polymeric fibers such as polyamide, polyester or the like which permits each half section 12 and 14 of the carrying case to be pivoted at least about 180 degrees so as to permit fully opening the carrying case 10. The carrying case 10 is opened and closed by any conventional means such as a zipper 16, snaps (not shown) or the like. In addition, the carrying case 10 includes a connector arrangement comprising a connector 18 which can be secured to a strap 20. The connector 18 cooperates with a second connector (not shown) on half section 14 so that they can be joined together to form a support for the case 10. The connectors assist in maintaining the case 10 closed or maintaining it open in a manner described below. The case 10 also can be provided with a sleeve 13 through which a rigid bar, rope or the like can be threaded for the purpose of supporting the case 10 in a desired position.

Figure 2:
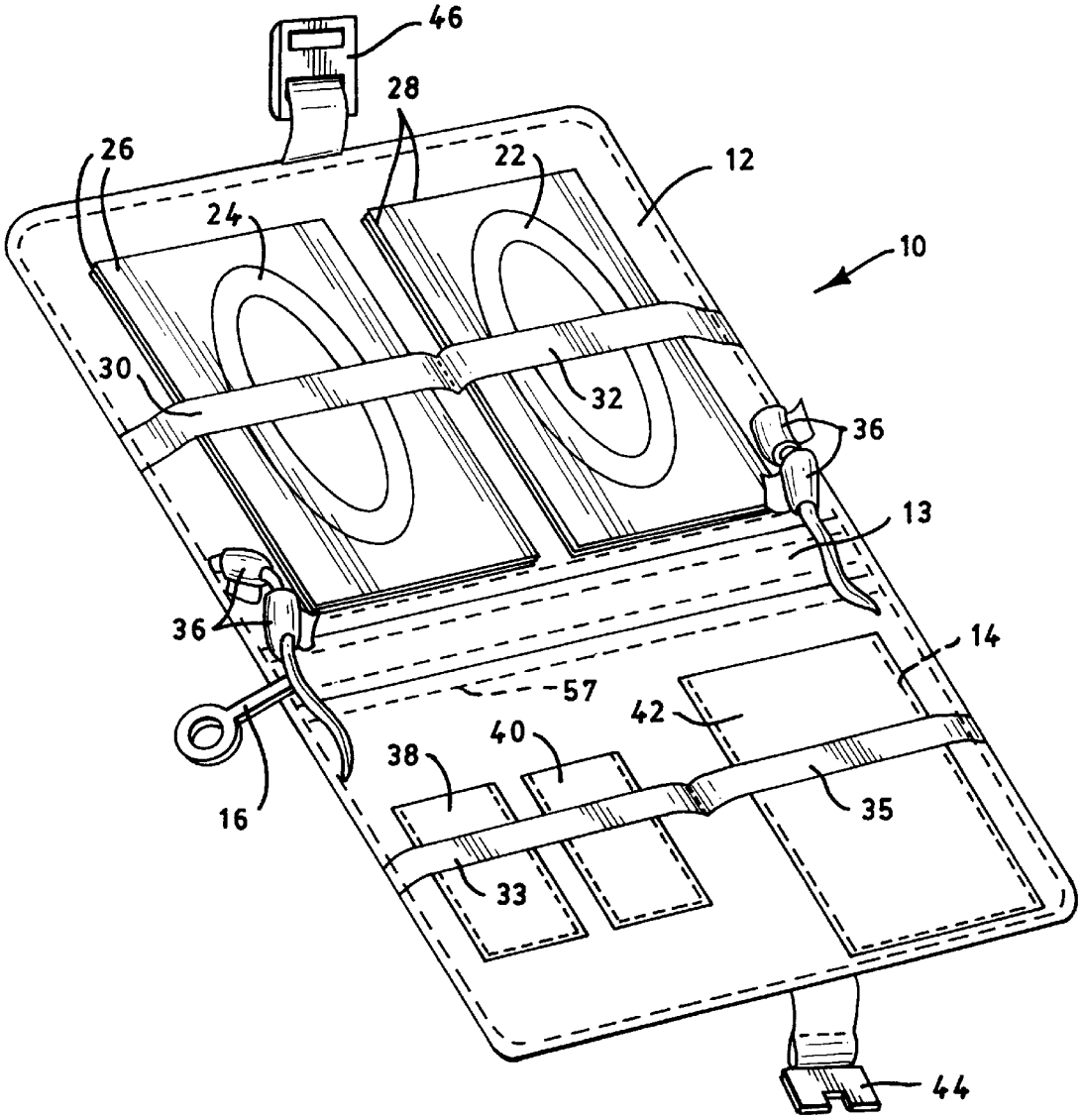
FIG. 2 is a top view of an open scoring apparatus of this invention.

Referring to FIG. 2, the carrying case 10 is shown in an open flat position by releasing clasp 18 and opening zipper. The two half sections 12 and 14 are joined by connecting section 13. Two sets of indicia 22 and 24 such as numeric indicia are printed or the like on two sets of foldable substrates 26 and 28 which can be made of cloth, paper or the like with the number of different indicia and foldable substrates being appropriate to show scoring of a sporting event. Optional straps 30, 32, 33 and 35 can be included to retain the foldable substrates in a desired position such as when the sporting event is held in windy conditions. The straps are released when the score changes so that the substrates are positioned from a first half 12 of the carrying case 10 onto the second half 14 of the carrying case 10. The underside of the moved substrates 26 and 28 show the same score as the newly exposed substrates 26 and 28 so that both halves 12 and 14 of the carrying case 10 show the same score. Thus spectators positioned in different portions of a sporting arena can view the correct score of the sporting event. In an event such as tennis or volleyball where scores such as sets or games in addition to the game being played are also being scored, additional markers such as colored beads 36 or the like can be maintained in a position that is representative of their number. The case half 14 can optionally be provided with pockets 38, 40 and 42 to provide storage for paraphernalia such as rules or the like for use in connection with a sporting event. The clasp 18 is formed of a male member 44 and a female member 46 which can be attached or detached.

Figure 3:
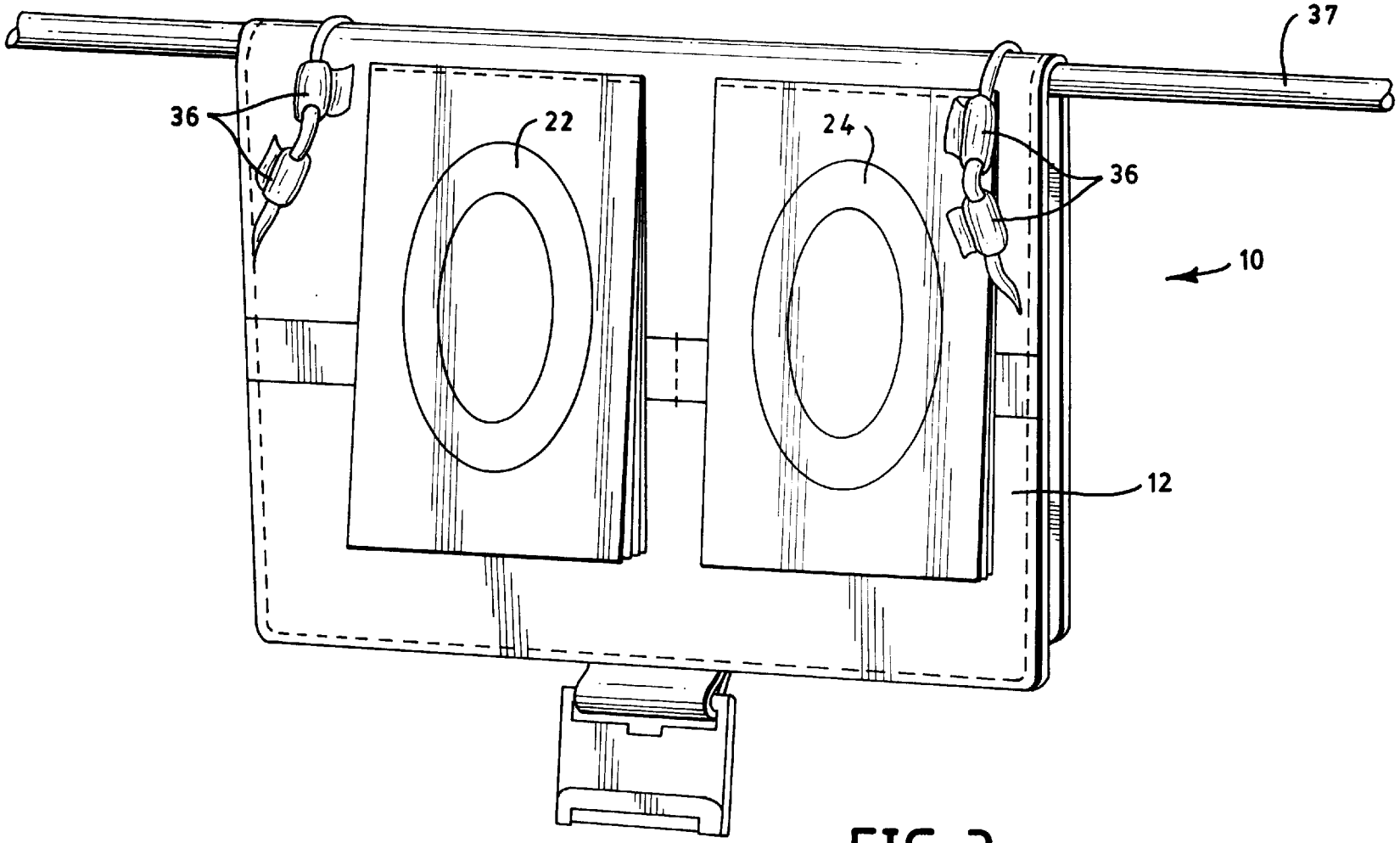
FIG. 3 is a perspective view of the scoring apparatus of this invention, when open and hung from a rope.

As shown in FIG. 3, the case 10 can be hung on a rope or the like such as a tennis net or volleyball net rope.

Figure 4:
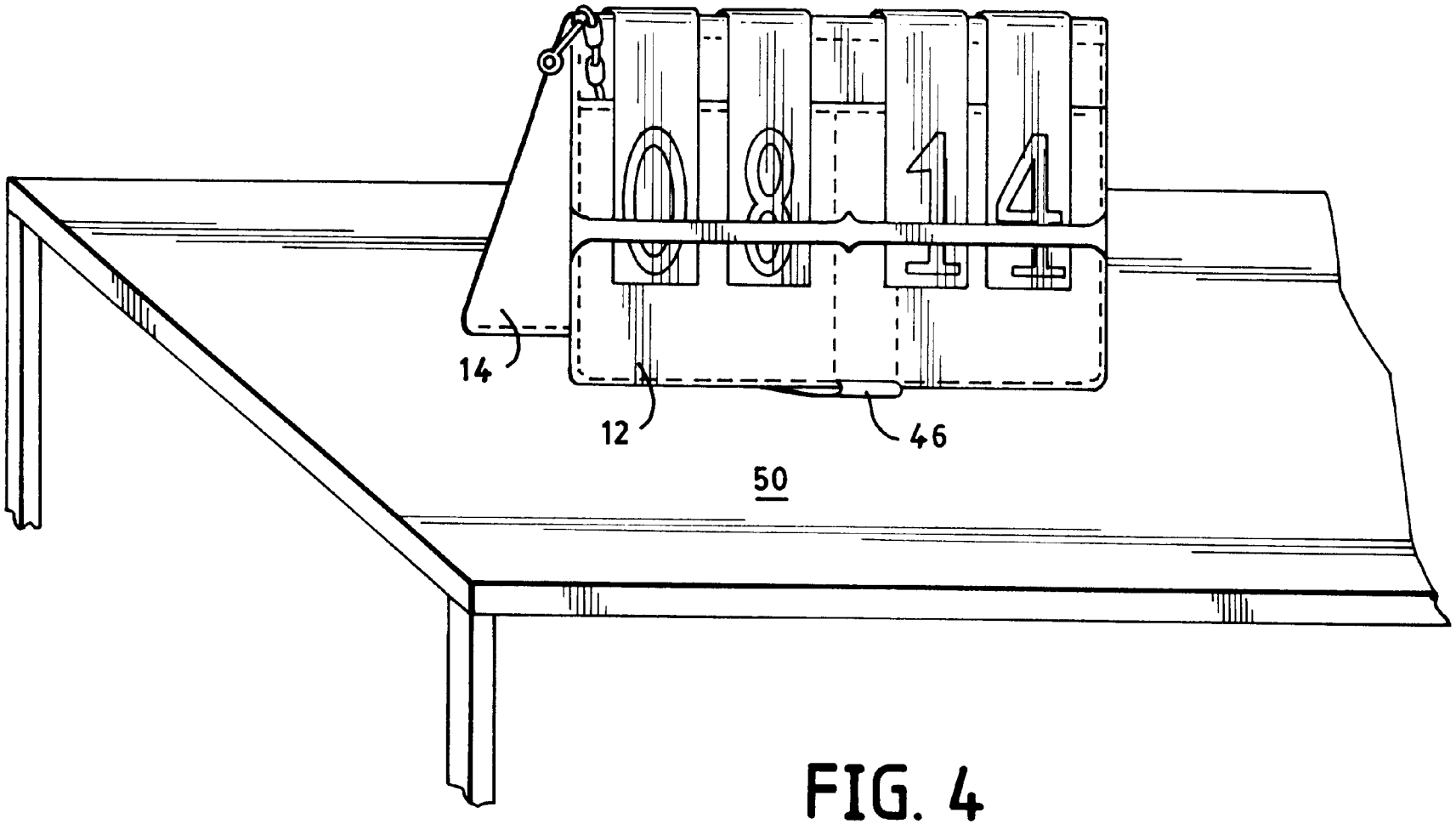
FIG. 4 is a perspective view of the scoring apparatus of this invention positioned on a horizontal surface.

Alternatively, the open case 10 can be positioned on a horizontal substrate 50 by joining the connector elements 44 and 46 between the case halves 12 and 14 in a tent-like position as shown in FIG. 4.

Figure 5:
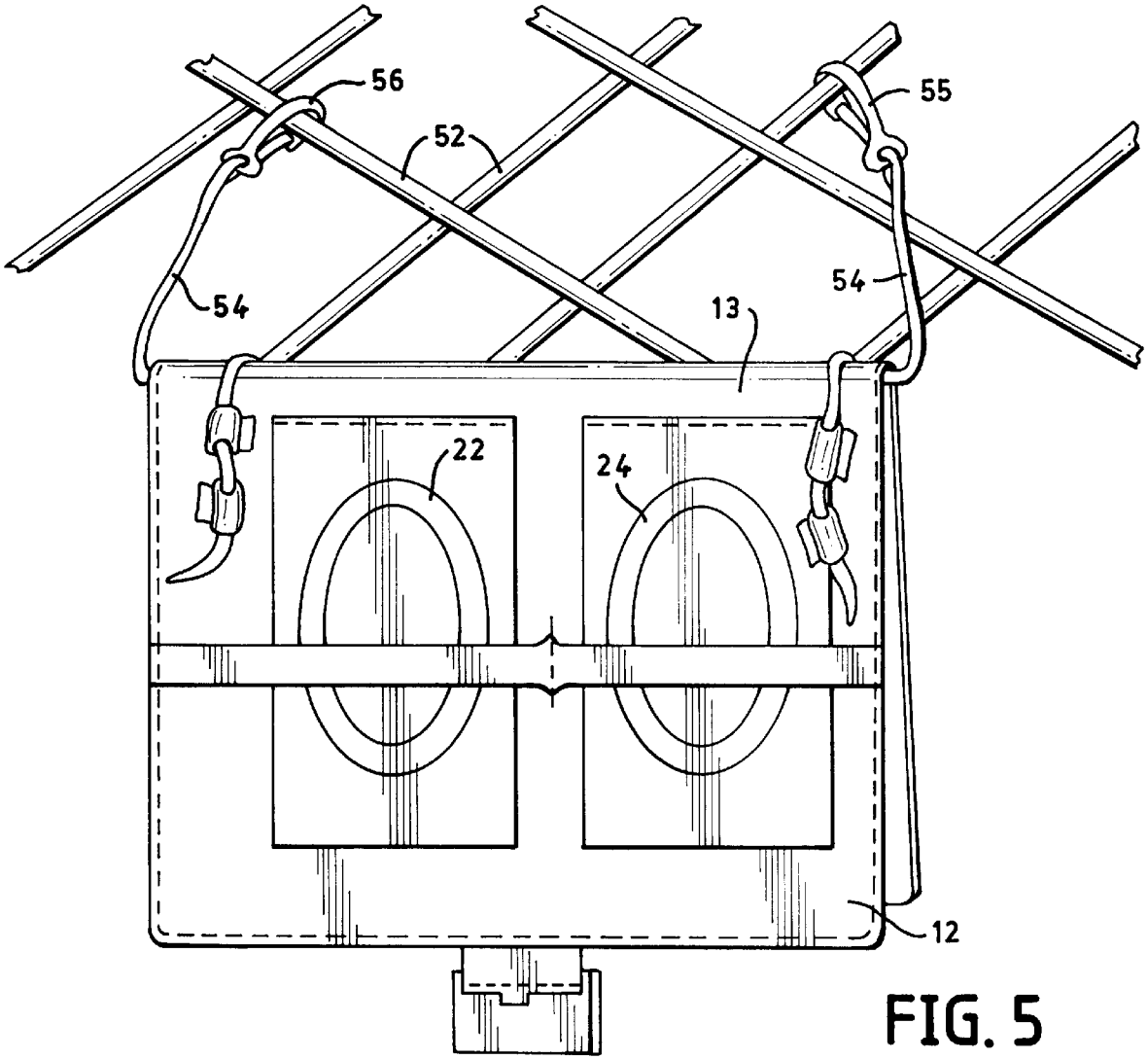
FIG. 5 is a front view of the scoring apparatus of this invention when hung on a substrate.

The case 10 also can be hung from a vertically positioned substrate such as a fence 52 as shown in FIG. 5. A rope or the like 54 is threaded through sleeve 13. The clamps 55 and 56 attached to the rope are attached to the vertical substrate 52.

I claim:

1. A portable scoring apparatus which comprises:

a portable carrying case formed of two half sections joined together by a flexible connecting section, said half sections capable of being pivoted about said connecting section with respect to each other at least about 180 degrees to position said half sections to be in an open position or in a closed position, means for joining said half sections together in a closed position, a first of said half sections having a first inside surface which is exposed to view when said half sections are in an open position, a plurality of scoring elements having numeric indicia on each of two surfaces of said scoring elements, said scoring elements being secured to said first inside surface in a manner which permits said scoring elements to be moved and supported by a second inside surface of a second of said half sections, the exposed numeric indicia supported by said first inside surface being the same numeric indicia supported by said second inside surface, and means for supporting said half sections in an open position.

2. The portable scoring apparatus of claim 1 wherein said second inside surface includes pockets.

3. The portable scoring apparatus of claim 1 wherein said connecting section includes a sleeve positioned on an outside surface of said carrying case.

4. The portable scoring apparatus of any one of claims 1, 2 or 3 wherein said means for supporting comprises a first connector positioned on an outside surface of said first half section and a second connector positioned on an outside surface of said second half section, said first connector and said second connector adapted to be joined together.

5. The portable scoring apparatus of any one of claims 1, 2 or 3 wherein said means for joining comprises a zipper.

6. The portable scoring apparatus of any one of claims 1, 2 or 3 including scoring indicia in addition to said numeric indicia.

7. The portable scoring apparatus of claim 4 wherein said means for joining comprises a zipper.

8. The portable scoring apparatus of claim 6 wherein said means for joining comprises a zipper.

* * * * *